United States Patent [19]

Wall et al.

[11] Patent Number: 4,671,404

[45] Date of Patent: Jun. 9, 1987

[54] DISPOSABLE HOLDER FOR FOOD ARTICLES

[75] Inventors: Eugene W. Wall, Claremont; Harry W. Wall; Harold J. Wall, both of Glendora, all of Calif.

[73] Assignee: Wall Machine Works, South El Monte, Calif.

[21] Appl. No.: 853,189

[22] Filed: Apr. 17, 1986

[51] Int. Cl.[4] ..... B65D 5/00

[52] U.S. Cl. ..... 206/45.14; 206/525; 206/45.24

[58] Field of Search ..... 229/22, 16 D; 206/525, 206/44 B, 45.14, 45.24

[56] References Cited

U.S. PATENT DOCUMENTS 337,544 3/1886 Yaggy ..... 229/22

1,705,116 3/1929 Howland ..... 229/22

*Primary Examiner*—Joseph Man-Fu Moy

*Attorney, Agent, or Firm*—Christie, Parker & Hale

[57] ABSTRACT

A disposable support for food articles such as tacos is made from a paper-like material folded and interlocked to form a generally triangular shape with an opening in upright inverted V-shaped faces of the support that forms a cradle for holding the food article. The disposable support is formed from a one-piece foldable sheet folded into three sections and having a first panel, a second panel adjacent the first panel, a first fold separating the first and second panels, a third panel adjacent the second panel, and a second fold separating the second and third panels. An elongated opening extends through the first and second panels across the first fold. An interlocking tab at the free end of the third panel is arranged so that when the sheet is folded across the first and second folds into flat form and the third panel is folded inside the first and second panels, the tab is located adjacent the first fold above slotted openings formed in the first and second panels by the large opening therein. The paper-like material has a memory so that when pressure is released from the flat form sheet, it causes the third panel to spring forward toward the first panel and the tab to interlock with the edges of the slotted opening in the first panel so that the third panel moves downwardly rapidly toward the bottom of the slotted opening to form a stabilizing base for a triangular supporting structure in which the first and second panels form the opposite sides of an inverted V-shaped support on opposite sides of a cradle formed by the slotted openings therein.

12 Claims, 4 Drawing Figures

DISPOSABLE HOLDER FOR FOOD ARTICLES

FIELD OF THE INVENTION

This invention relates to a disposable support for holding food articles, such as tacos, in a upright position.

BACKGROUND OF THE INVENTION

For years, tacos have been a very popular food item in fast-food restaurants, Mexican restaurants, and for home use. However, tacos can be messy to handle when preparing them or when they are eaten. Tacos are often prepared in restaurants by manually filling the taco shell with the ingredients, as they are when prepared at home. After they are filled and when they are not being held by hand during eating, tacos are usually set down by laying them on their sides. Tacos can be especially messy to handle when laid on their sides, because the contents often fall out of the shell.

This invention provides a disposable upright support that can be used to hold tacos in an upright position rather than laying them on their sides. The support can be used during and after filling the tacos, for restaurant or home use, or they can be used as a disposable item in restaurants or in the home for holding tacos in an upright position when they are set down during eating. As a result, tacos can be significantly less messy to handle when preparing them or when they are eaten.

SUMMARY OF THE INVENTION

Briefly, the present invention provides a disposable upright holder for food articles. The holder automatically opens from a thin, flat form to a locked, supportive position for holding food articles, such as tacos or taco shells, in a upright position. In its upright supportive position, the holder has a generally triangular shape with a pair of upwardly converging faces. A generally horizontal base extends from the bottom of one face and interlocks with a bottom portion of the other face. The interlocked base provides a wide lower means of support to hold the triangular faces of the holder in a fixed and stable supportive position. The upright faces have cut away portions opposing one another that cooperative to provide a cradle for holding the food article in an upright position.

In a preferred embodiment, the upright faces of the holder are folded over along the top of the triangular support. The juncture between the base and the bottom edge of one upright face is formed by a long straight fold line. The opposite end of the base has an interlocking tab which slidably interlocks with a tapered groove formed in the opposite upright face of the holder. The holder can be folded into flat form by folding the base about its long fold line into a position between opposite faces of the holder. Finger pressure can hold it in the flat folded position. The holder can automatically spring from its flat folded position into its supportive triangular position when the finger pressure is released. This causes the opposite faces of the holder to spring apart and the interlocking tab to move lengthwise along a groove in one face of the holder while the base automatically moves to a horizontal stabilizing position at the bottom of the triangular support.

Thus, the holder can be held in its flat form by finger pressure, or when stacked in a dispenser; and when finger pressure is released, or the holder is removed from the dispenser, the holder automatically flips immediately into its open supportive position.

The holder can be made for a very low price from flat paper sheet stock material. It is made by simply stamping it into the proper shape and folding it. The holder is simply folded into flat form during the manufacturing process without requiring interlocking of one portion to another. The holder interlocks when used, and the interlocking occurs automatically, simply by releasing the pressure that holds it in its flat form. The holder can be easily used, and is especially useful as a large scale disposable item for stacking in dispensers. The holder is easily removed from the dispenser in its flat form and quickly and easily placed in its locked supportive position without any physical manipulation.

These and other aspects of the invention will be more fully understood by referring to the following detailed description and the accompanying drawings.

DRAWINGS

DETAILED DESCRIPTION

Figure 1:
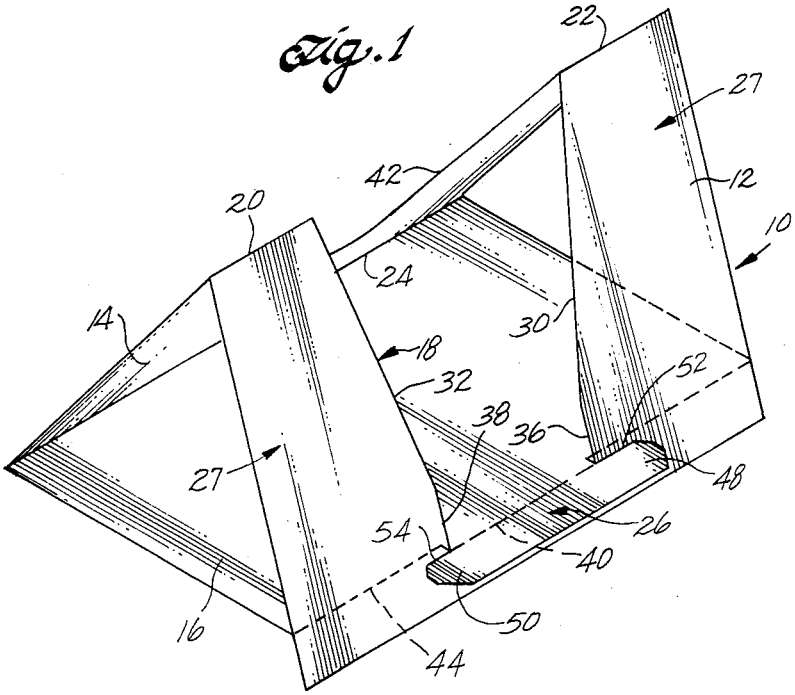
FIG. 1 is a perspective view showing a food article holder in a supportive position.
Figure 4:
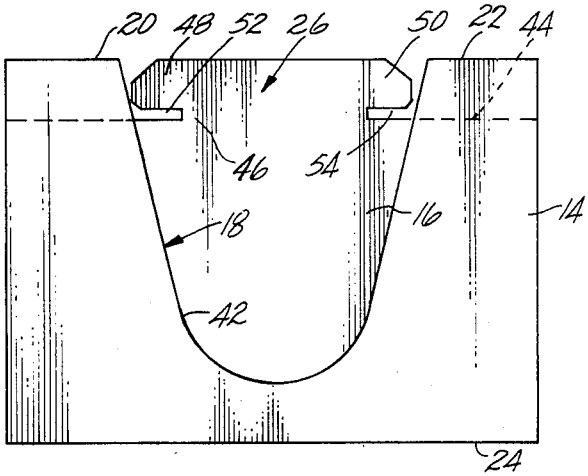
FIG. 4 is a rear elevation view of the holder in its folded position.
Figure 3:
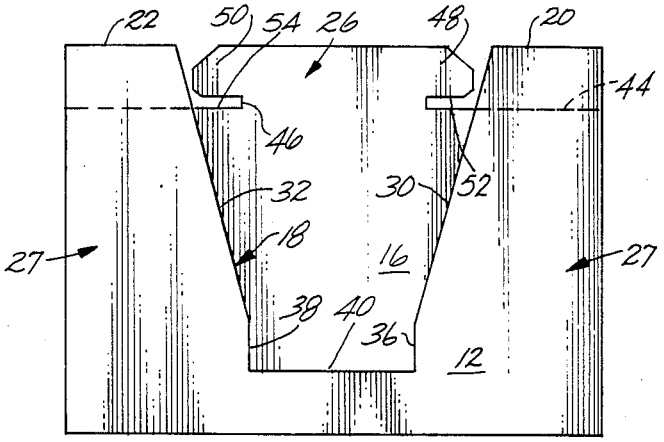
FIG. 3 is a front elevation view of the holder in its folded position.
Figure 2:
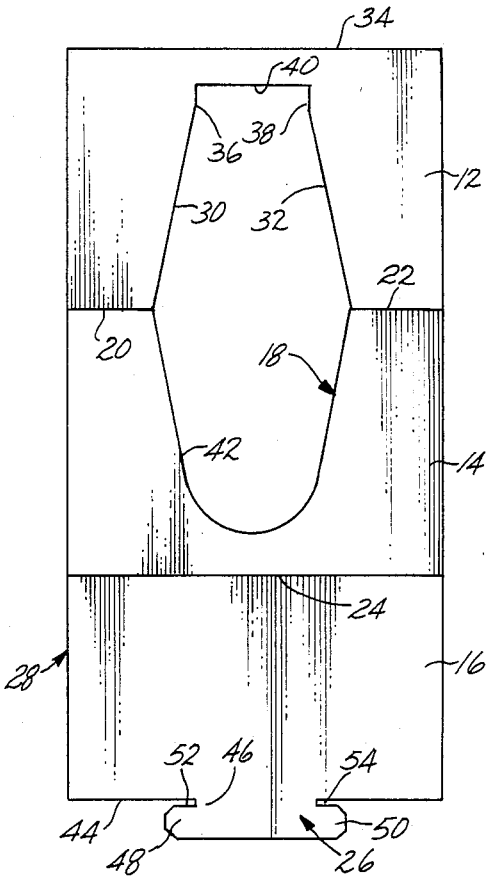
FIG. 2 is a top plan view showing the holder in flat form prior to folding.

FIG. 1 illustrates a disposable support or holder 10 for holding food articles, such as tacos or taco shells, in an upright position. FIG. 1 illustrates the support in its upright supportive position. FIG. 2 illustrates the support in flat form after it is cut from paper stock and before it is folded into flat form. FIGS. 3 and 4 illustrate opposite faces of the food holder in flat form before it is opened into the supportive position illustrated in FIG. 1.

In the supportive position illustrated in FIG. 1 the support is generally elongated and triangular-shaped, similar to a pup tent. It has a flat front face 12, a flat rear face 14 and a flat base 16. The front and rear faces 12 and 14 converge upwardly toward each other to form the two upright sides of the triangle. A large opening 18 cut in the front and rear faces forms a cradle when the triangular support rests in its supportive position. The cradle opens upwardly through the top edge of the triangle. The top edge of the triangle is formed by the upper ends of the front and rear faces where they converge along a pair of short, straight fold lines 20 and 22. These fold lines are collinear and on opposite sides of the cradle formed by the openings in the front and rear faces. A long fold line 24 forms the juncture between one end of the base 16 and the bottom of the rear face 14. An interlocking tab 26 interlocks the free end of the base with the bottom portion of the opening in the front face 12. The tab connects the base to the bottom portion of the front face 12 to hold the front face in a fixed position relative to the free end of the base. The base has sufficient stiffness to stabilize the opposite faces of the support in the triangular upright supportive position shown in FIG. 1. The opposite faces of the support extend upwardly on opposite sides of the cradle 18 to form a pair of spaced apart inverted V-shaped supports 27 held in a fixed position by the supporting base 16.

The technique for making the support is understood best by referring to FIG. 2. The support is preferably made from a flat paper sheet 28 having sufficient thickness to provide the stiffness necessary for holding the inverted V-shaped uprights 27 in a fixed relatively stiff upright supportive position during use. The paper sheet also has sufficient thickness to withstand a stamping operation for cutting it into the profile shown in FIG. 2. The paper sheet has sufficient stiffness that it contains a memory or has a "spring-back" function when folded. That is, when the paper is folded back on itself and held in a flat position by finger pressure, and if the finger pressure is then released, the folded-over portion will spring back away from the portion on the opposite side of the fold. This spring-back function is useful in enabling the support to be folded flat and then released to automatically flip into the open position illustrated in FIG. 1.

The paper sheet 28 in its flat form profile of FIG. 2 is generally rectangular. The sheet is folded into three sections of substantially equal length. The large opening 18 is cut from the sections forming the upper two-thirds of the rectangular sheet. The short fold lines 20 and 22 form the juncture between the front face panel 12 and rear face panel 14 which combine to form the upper two-thirds of the sheet 28. The widest portion of the central opening 18 is at the juncture formed by the fold lines 20 and 22. The large opening 18 has a pair of long, straight edges 30 and 32 which taper toward one another in a direction away from the fold lines 20 and 22 toward a bottom edge 34 of the front face panel 12. The tapered edges form the major length of the opening in the front face panel 12. A pair of short parallel edges 36 and 38 form narrowed end portions of the opening below the tapered edges 30 and 32. The parallel edges 36 and 38 extend for a short distance toward the bottom edge 34 of the front face panel 12, and then the opening has a right angle cut that forms a bottom edge 40 at the end of the opening. The bottom edge 40 of the opening is parallel to the bottom edge 34 of the front panel 12. Both of these edges are also parallel to the fold lines 20 and 22 and the fold line 24.

The portion of the opening 18 in the rear face panel 14 is a generally U-shaped cut 42 having opposite edges which taper toward one another away from the fold lines 20 and 22 toward the long fold line 24 that forms the juncture between the rear face 14 and the base panel 16. The U-shaped cut extends most of the length of the rear face panel 14. The widest portion of the U-shaped cut is at the juncture formed by the fold lines 20 and 22; this portion of the U-shaped cut has the same width as the widest distance between the tapered edges 30 and 32 of the opening 18.

The tab portion 28 is cut at the opposite end 44 of the paper sheet. The tab has a narrow necked portion 46 integral with the end of the sheet. Ears 48 and 50 project outwardly from opposite sides of the necked portion of the tab. The ears are spaced from the bottom edge 44 of the sheet by narrow slotted openings 52 and 54 between the tab and the bottom edge 44 of the sheet.

In a preferred embodiment, the dimensions of the sheet 28 in the profile shown in FIG. 2 are as follows. The entire length of the sheet 28 is about $7\frac{1}{2}$ inches, including the width of the tab 26. Each of the sections 12, 14 and 16 is each about $2\frac{1}{2}$ inches in length. The width of the tab from its outer edge to the adjacent edge 44 of the base panel 16 is about $\frac{3}{8}$ inch so that the length of the base panel 16, not including the tab, is $2\frac{1}{8}$ inches. The width of the sheet 28 is about $3\frac{1}{2}$ inches. The width of the narrow slotted openings 52 and 54 on opposite sides of the tab is about 1/16 inch, and the width of the tab is $1\frac{3}{4}$ inch. The necked portion of the tab has a width of $1\frac{1}{8}$ inch. The maximum width of the opening 18, between the folded lines 20 and 22, is $1\frac{7}{8}$ inch on-center. The curved end portion of the U-shaped opening 42 has a radius of $\frac{5}{8}$ inch. The length between the end of the U-shaped opening 22 and the folded line 24 is $\frac{3}{8}$ inch. The length of the short parallel edges 36 and 38 is $\frac{1}{4}$ inch and the width of the bottom edge 40 of the opening is $1\frac{1}{8}$ inch. The bottom edge 40 of the opening is spaced from the edge 34 of the sheet by 5/16 inch.

After the sheet is cut into the flat form profile shown in FIG. 2, the sheet is folded to form the support. Referring to FIG. 2, the sheet is folded across the fold line 24 and across the fold lines 20 and 22 so that the front face panel 12 and the base panel 16 extend upwardly from the plane of the rear face panel 14 which rests on a supporting surface. The base panel 16 is then folded down toward the rear face panel 14, so the tab 26 overlies the wider portion of the opening 18 between the folds 20 and 22. The front face panel 12 is then folded down over the top of the base panel 14 so that the base panel is located between the front face panel and the rear face panel. The folded support is then in a thin flat form shown in FIGS. 3 and 4.

In its flat form shown in FIG. 3, the tab 26 is located above the widest portion of the opening 18, between the short fold lines 20 and 22. The free end 44 of the base panel 16 is spaced below the short fold lines 20 and 22 at the top of the folded support. The free end 34 of the front face panel 12 forms the bottom edge of the support in its folded position shown in FIG. 3. In the folded position of FIG. 3, the outer edges of the ears 48 and 50 of the tab 26 are spaced a short distance inwardly from the adjacent tapered edges 30 and 32 of the opening 18 in the front face panel 12.

FIG. 4 shows the opposite side of the folded support in its flat form in which the tab 26 is located above the wider portion of the U-shaped opening 42 in the rear face 14 of the support. Again, the outer edges of the ears 48 and 50 at opposite ends of the tab 26 are spaced inwardly a short distance from the adjacent tapered edges of the U-shaped opening 42. The tab is located at the widest portion of the U-shaped opening between the folds 20 and 22. The long fold 24 between the base 16 and the rear face 14 forms the bottom edge of the support in the folded position of FIG. 4.

The support can be used by first stacking a large number of the individual supports in their folded position in a dispenser (not shown). The folded supports are preferably stacked vertically within a dispenser having a rectangular interior configuration to match the shape of the folded support. The dispenser can be arranged so that the tab portion 26 of each folded support at the bottom of the stack can be grasped by hand to pull the folded support out from under the stack. The folded support is then ready for use.

The folded support is best used by first placing it in the upright position shown in FIG. 3. The opposite sides of the support are simply held together by finger pressure to hold the support in its folded position. The finger pressure is then simply released. This automatically flips the support into the locked triangular supportive position shown in FIG. 1. When finger pressure is released, the base panel 16, which has been folded inside the front and rear face panels, automatically flips down while the front face panel at the same time automatically springs outwardly from the folds 20 and 22.

This causes the tab to slide downwardly instantly along the tapered edges 30 and 32 to the bottom of the opening 18 in the front face panel 12. In the supportive position of the support, the tab rests on the bottom edge 40 of the opening in the front face panel 12; and in this position, the base panel 16 provides a reasonably stiff means of support for holding the upright portions 27 of the support in the locked position shown in FIG. 1. As the base panel 16 flips downwardly, after pressure is released, the tab portion of the base pivots forwardly (as viewed in FIG. 1) so that the ears 48 and 50 of the tab interlock with the tapered opening in the front face 12. The tapered edges 30 and 32 of the opening 18 are engaged with the narrow slots 52 and 54 underneath the ears 48 and 50 of the tab so that the tab quickly interlocks with the tapered edges of the opening as soon as the pressure is released. The interlocked tab then quickly slides downwardly along the tapered edges of the opening 18. Near the bottom of the opening 18, the opposite edges 36 and 38 are at their narrowest point, and the short parallel edges 36 and 38 guide the moving tab and base panel downwardly until the interlocked portion of the base engages the bottom edge 40 of the opening 18. The narrow spacing between the outside edges of the tab and the tapered edges of the opening ensure that the tab will interlock with the front face panel immediately after pressure is released and the tab has rotated forward only a short distance. Once finger pressure is released from the folded support, in a flash it automatically opens from the paper thin flat position to its locked supportive position shown in FIG. 1. This is done without any additional physical help. The stiffness of the paper is such that the paper has a memory or spring-back function so that the base 16 can automatically spring forward, pivoting about its fold 24, while at the same time the front face panel 12 springs forward about the folds 20 and 22.

Although a variety of materials can be used to provide a disposable support having the memory or spring-back function, the preferred material is paper having a thickness in the range of 5 to 20 thousandths of an inch. The preferred type of paper has a grain that extends lengthwise with respect to the rectangular support illustrated in FIG. 2. This improves the spring-back function.

Thus, the invention provides a disposable support which can be folded into a thin, flat form and used for stacking in a dispenser. The support can be easily removed from the dispenser and held by finger pressure and then when released, it automatically flips into its supportive position shown in FIG. 1 in which the triangular supports 27 on opposite sides of the central cradle 18 provide a means of support for food articles such as tacos or taco shells.

Although the invention has been described with reference to the holder having the particular structural arrangement shown in FIG. 1 for use as a holder for tacos, it is to be understood that other similar structures can be used as a disposable temporary support for other food articles, or other articles as well, without departing from the scope of the invention.

What is claimed is:

1. A disposable holder for food articles and the like comprising:

an elongated thin, bendable and foldable one-piece sheet folded into sections which include a front face, a rear face, a first fold between the front face and the rear face, a base, and a second fold between the rear face and the base;

an elongated continuous opening extending across the front face, past the first fold, and across the rear face of the sheet;

the front face having a free end opposite the first fold; the base having a free end opposite the second fold, with a tab projecting from the free end of the base to form interlocking means on the base;

the sheet being foldable to a folded position in which the front face is folded toward the rear face about the first fold, and the base is folded about the second fold so the base extends between the front face and the rear face for positioning the tab within the opening adjacent the first fold of the folded sheet;

the sheet having a sufficient memory that a release of pressure from the folded position of the sheet causes the base to automatically fold away from the rear face about the second fold toward the free end of the front face while the front face essentially simultaneously folds away from the rear face about the first fold, causing the interlocking means of the tab to engage opposite edges of the opening in the front face as the base and tab travel automatically along the opening in the front face to a stabilized position near the free end of the front face in which the interlocking means of the tab automatically interlocks with the edges of the opening in the front face to position the base so it holds the front face and rear face in said stabilized position, and in which the front face and rear face form opposite sides of upright supports above the stabilizing base so the opening forms a cradle between the upright supports for holding an article in the stabilized cradle.

2. Apparatus according to claim 1 in which the portion of the opening extending through the front face tapers narrower toward the free end of the front face.

3. Apparatus according to claim 2 in which outer edge portions of the opening in the front face have tapered and generally parallel edges for guiding the interlocking tab to its locked position.

4. Apparatus according to claim 1 in which the width of the tab is slightly less than the width of the opening at the first fold.

5. Apparatus according to claim 1 in which the sheet is made of paper of sufficient stiffness such that each folded portion of the paper sheet can spring back about its fold when pressure is released.

6. Apparatus according to claim 1 in which the holder in its supportive stabilized position is generally triangular with the front and rear faces being inverted V-shaped and held in a fixed upright position by the interlocking base which forms the bottom of the triangle.

7. A holder for food articles and the like made from a one-piece thin, flat sheet foldable into at least three sections comprising:

a first panel, a second panel adjacent the first panel, a first fold separating the first and second panels, a third panel adjacent the second panel, and a second fold separating the second and third panels;

an elongated continuous opening extending through the first and second panels and across the first fold; and an interlocking tab on a free end of the third panel opposite from the second fold, the tab being disposed such that when the sheet is folded across the first and second folds into flat form with the third panel folded inside the first and second panels, the tab is located adjacent the first fold above slotted openings formed in the first and second panels by the continuous opening therein so that release of pressure from the flat form sheet causes the third panel to automatically fold toward the first panel and the tab thereon to travel along the opening in the first panel and automatically interlock with opposite edges of the slotted opening in the first panel to form an upright support in which the first and second panels extend upwardly on opposite sides of the slotted openings therein while the tab has interlocked with the first panel so the third panel forms a stabilizing base between spaced apart lower portions of the first and second panels, and in which the slotted openings combine to form an open-topped cradle in the first and second panels which is stabilized by the interlocked third panel at the base of the cradle.

8. Apparatus according to claim 7 in which the portion of the opening extending through the first panel tapers narrower toward the free end of the first panel.

9. Apparatus according to claim 7 in which the width of the tab is slightly less than the width of the opening at the first fold.

10. Apparatus according to claim 7 in which the sheet is made of paper of sufficient stiffness such that each panel of the sheet can spring back about its fold when pressure is released.

11. Apparatus according to claim 5 in which the holder in its stabilized position is generally triangular with the first and second panels being inverted V-shaped and held in a fixed upright position by the interlocking third panel which forms the bottom of the triangle.

12. A disposable holder for food articles and the like comprising:

an elongated thin, bendable and foldable one-piece sheet folded into sections which include a front face, a rear face, a first fold between the front face and the rear face, a base, and a second fold between the rear face and the base;

an elongated continuous opening extending across the front face, past the first fold, and the across the rear face of the sheet;

the front face having a free end opposite the first fold; the base having a free end opposite the second fold, with a tab projecting from the free end of the base to form interlocking means on the base;

the sheet being foldable to a folded position in which the front face is folded toward the rear face about the first fold, and the base is folded about the second fold, so the base extends between the front face and the rear face for positioning the tab within the opening adjacent the first fold of the folded sheet;

the sheet having a sufficient memory that a release of pressure from the folded position of the sheet causes the base to automatically snap away from the rear face by pivoting about the second fold toward the free end of the front face while the front face eseentially simultaneously pivots away from the rear face about the first fold, causing the tab to automatically travel along the opening in the front face and the interlocking means of the tab to automatically engage opposite edges of the opening in the front face near the free end of the front face without manual assistance to lock the holder in a stabilized position in which the interlocking means of the tab interlocks with the edges of the opening in the front face to position the base so it holds the front face and rear face in said stabilized position, and in which the front face and rear face form opposite sides of upright supports above the stabilizing base so that the continuous opening forms a cradle between the upright supports for holding an article in the stabilized cradle.

* * * * *